United States Patent [19]

Bernhardson

[11] Patent Number: 4,611,822

[45] Date of Patent: Sep. 16, 1986

[54] CROSS COUNTRY SKI BINDING

[76] Inventor: Gary E. Bernhardson, Box 2301, Soldotna, Ak. 99669

[21] Appl. No.: 798,944

[22] Filed: Nov. 18, 1985

Related U.S. Application Data

[63] Continuation-in-part of Ser. No. 484,913, Apr. 14, 1983, Pat. No. 4,557,498.

[51] Int. Cl.[4] ..... A63C 9/10

[52] U.S. Cl. ..... 280/615; 280/632; 403/14; 403/330

[58] Field of Search ..... 280/614, 615, 631, 632, 280/611; 403/13, 14, 330; 292/121, 128

[56] References Cited

U.S. PATENT DOCUMENTS

| | | | |
|---|---|---|---|
| 4,148,502 | 4/1979 | Staufer et al. | 280/615 |
| 4,184,696 | 1/1980 | Settembre | 280/615 |
| 4,191,396 | 3/1980 | Biermann et al. | 280/615 |
| 4,219,216 | 8/1980 | Settembre | 280/615 |
| 4,382,611 | 5/1983 | Salomon | 280/615 |
| 4,410,199 | 10/1983 | Eisenberg | 280/615 |

FOREIGN PATENT DOCUMENTS 103004 1/1924 Switzerland .

OTHER PUBLICATIONS

Artex Brochure (1984/85).

*Primary Examiner*—John J. Love
*Assistant Examiner*—Michael Mar
*Attorney, Agent, or Firm*—Merchant, Gould, Smith, Edell, Welter & Schmidt

[57] ABSTRACT

A cross country ski binding (10) includes a base plate (16), a pivot plate (18) hinged to the base plate, an upstanding transverse lug (36) on the pivot plate for receiving a slotted toe plate (38) on the ski boot, and a wire clamp (54) for releasbly securing the toe plate and ski boot to the pivot plate. A vertical tongue-and-slot arrangement together with abutting engagement between the pivot plate (18) and toe plate (38), in combination with the releasable wire clamp (54), provide a more positive connection while at the same time allowing free pivotal movement of the boot relative to the ski. In a second embodiment, the ski binding (70) includes a horizontal tongue-and-slot arrangement (74, 76 and 78) together with a latch (84) resiliently urged into engagement with a slot (86) in the toe plate (38').

10 Claims, 11 Drawing Figures

FIG. 4
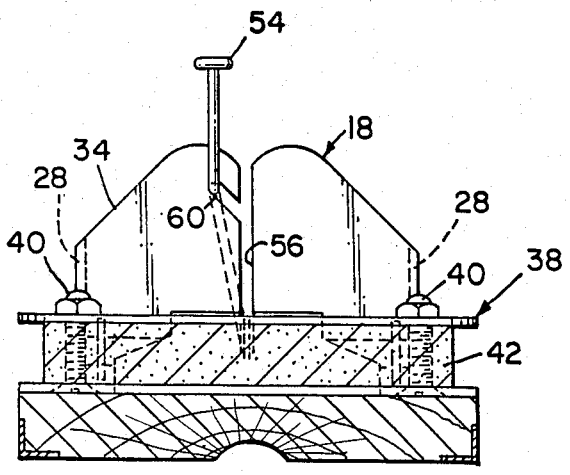
FIG. 5
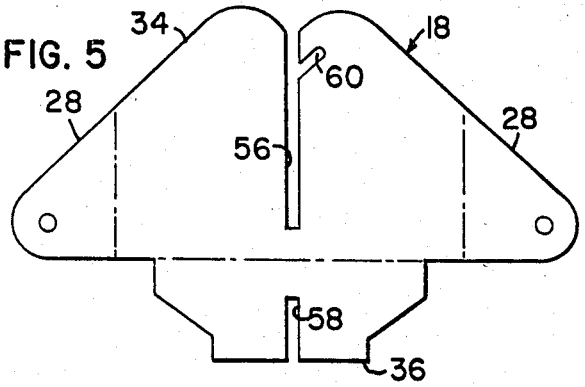
FIG. 6
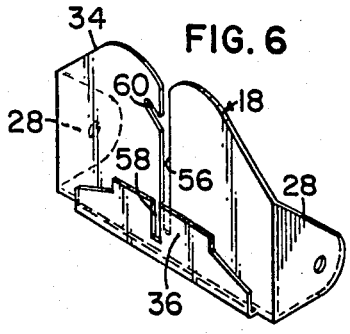
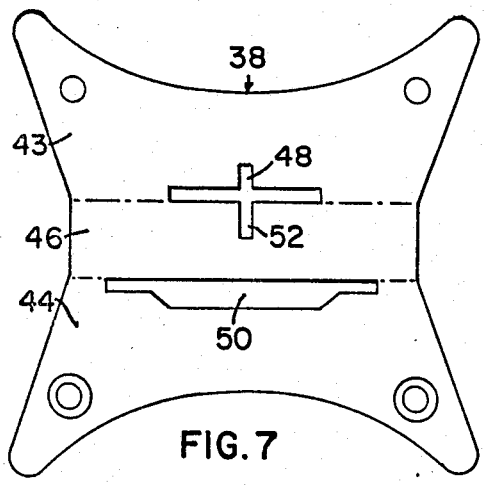
FIG. 7
FIG. 8
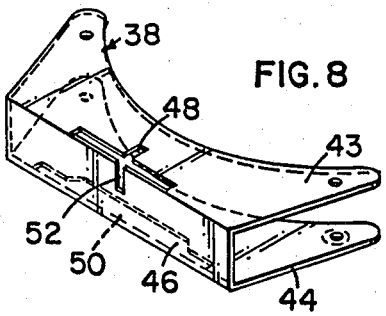

FIG. 9
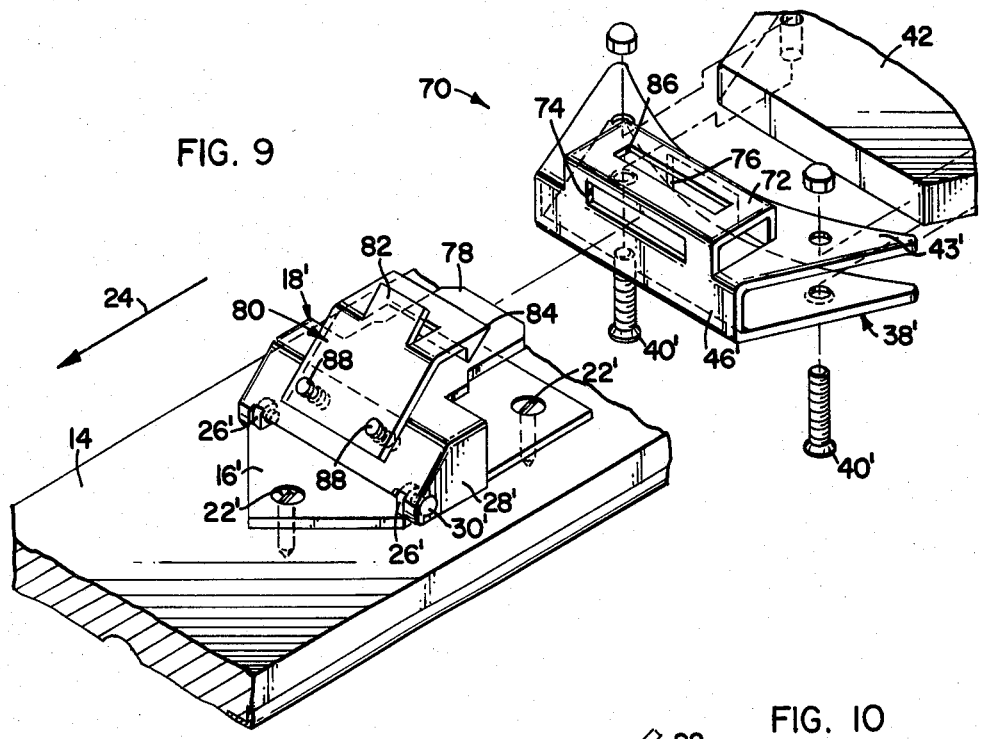
FIG. 10
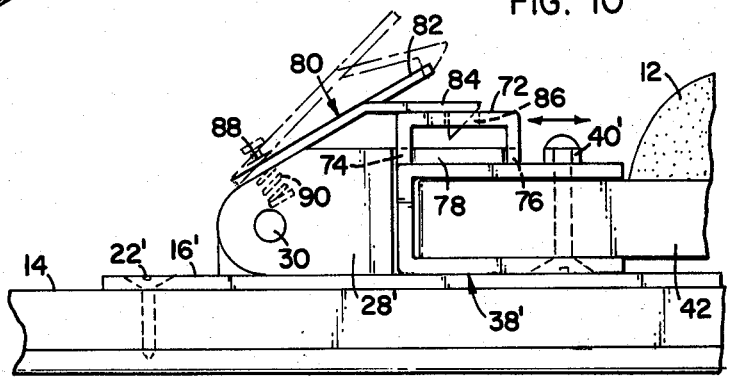
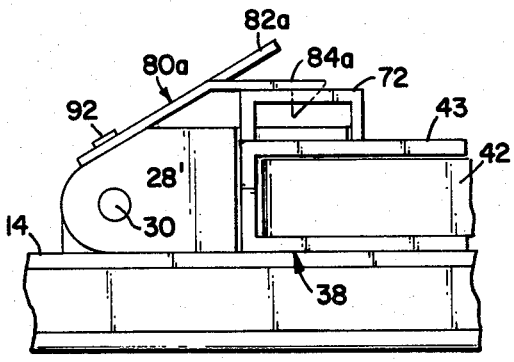
FIG. 11

CROSS COUNTRY SKI BINDING

CROSS-REFERENCE TO RELATED APPLICATION

This application is a continuation-in-part of co-pending allowed application Ser. No. 484,913, filed Apr. 14, 1983 now U.S Pat. No. 4,557,498.

TECHNICAL FIELD

The present invention relates generally to ski bindings, and more particularly to a cross country ski binding of the toe-binding type which utilizes a tongue-and-slot connection in combination with abutting engagement across the binding and a clamp wire to effect more positive connection between the boot and binding.

BACKGROUND ART

Cross country skiing involves a striding and gliding motion, which in turn requires that the heel of each ski boot be lifted and lowered relative to the corresponding ski with each kick. For this reason, the soles of cross country ski boots are typically provided with extending toe portions for connection to the ski. Cross country ski bindings are therefore adapted to allow for releasable connection to the ski boots and relative pivotal motion between the skis and ski boots.

Cross country ski bindings of the toe-binding type usually consist of a toe iron anchored to the ski and some means for releasably clamping it to the toe portion of the sole of the ski boot. The clamp often consists of resilient sturdy wire which can be moved into or out of engagement with a hook or slot to selectively clamp the toe portion of the sole of the ski boot in place. Such wire clamps can typically be manipulated with a ski pole by the skier while standing, and lugs or spikes are frequently provided on the toe iron for engaging recesses in the sole of the ski boot to constrain the ski boot against lateral, longitudinal and rotational movement relative to the ski binding. U.S. Pat. No. 3,905,612 to Kjellstrom illustrates a ski binding representative of this type.

Ski bindings of this type, however, operate primarily on a clamping principle in which the toe of the ski boot is secured directly to the ski such that the lifting action is provided by the flexibility of the boot sole. Since boot soles are not completely flexible, this tends to impair the necessary action and thus movement of the skier. In addition, such constant flexing of the boot sole tends to loosen the boots from the bindings which in turn reduces the degree of control over the skis.

The problems associated with this type of cross country ski binding have been addressed by providing toe irons with pivotal portions for connection to the ski boots in order to achieve greater freedom of pivotal movement between the boots and skis by reducing the importance of the flexibility of the ski boot soles. Ski bindings of this type have performed better than the former kind, but have tended to be relatively more complicated and thus expensive. My prior U.S Pat. No. 4,165,888 shows a ski binding having a relatively fewer number of parts and a combined clamp/hinge member to overcome some of these problems. Even this type of ski binding incorporates spikes which fit into recesses in the sole of the ski boot for additional constraint, and is thus still subject to some loosening in this regard during use.

The ski bindings of the prior art, however, have still not adequately addressed the problem of achieving positive releasable connection between the ski boots and bindings in a manner which minimizes play and improves control over the skis.

SUMMARY OF INVENTION

The present invention comprises an improved cross country ski binding which overcomes the foregoing and other difficulties associated with the prior art.

In accordance with a first embodiment of the invention, there is provided a ski binding of the toe-binding type utilizing a vertical tongue-and-slot arrangement in combination with a wire clamp to facilitate alignment and positive connection to a pivotal portion of the binding. The binding herein comprises a front plate or fixed portion secured to the ski, and a rear plate or pivotal portion hinged to the front plate. The rear plate includes an upstanding transverse lug or tongue for receipt by a slotted toe plate secured to the sole of the ski boot. The upstanding tongue on the rear plate and corresponding slot on the toe plate are preferably tapered for self-centering and tight connection when fully engaged. The ski binding also includes a wire clamp, which is formed and mounted for movement relative to slots in the rear plate and toe plate to effect releasable connection of the boot to the binding. A hook or notch is provided on the rear plate of the binding for receiving the wire clamp to releasably secure it in locked position.

In accordance with a second embodiment of the invention, there is provided a ski binding of the toe-binding type utilizing a horizontal tongue-and-slot arrangement in combination with a spring latch to facilitate alignment and positive connection to a pivotal portion of the binding.

BRIEF DESCRIPTION OF THE DRAWINGS

A better understanding of the invention can be had by reference to the following Detailed Description in conjunction with the accompanying Drawing, wherein:

FIG. 4 is a section view taken along lines 4—4 of FIG. 2 in the direction of the arrows;

FIG. 5 is a plan view of a plate cut for use as the pivot plate;

FIG. 6 is a perspective view of the pivot plate after cutting and bending;

FIG. 7 is a plan view of a plate cut for use as the toe plate;

FIG. 8 is a perspective view of the toe plate after cutting and bending;

FIG. 9 is a perspective view of a ski boot and ski connected together by means of the second embodiment of the ski binding of the invention;

FIG. 10 is side view of the ski binding;

FIG. 11 is an illustration of a modification of the ski binding of the second embodiment.

DETAILED DESCRIPTION

Figure 1:
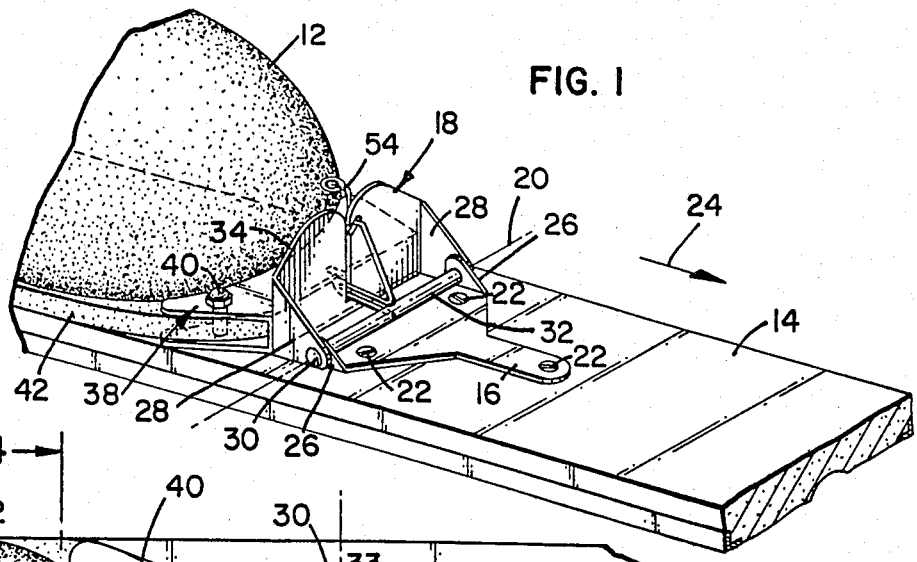
FIG. 1 is a perspective view of a ski boot and ski connected together by means of the first embodiment of the ski binding of the invention.

Referring to the Drawings, wherein like reference numerals designate corresponding elements throughout the views, there is shown the ski binding 10 incorporating a first embodiment of the invention. The binding 10 is of the toe-binding type, and is particularly adapted for positive pivotal and releasable connection of a ski boot 12 to a cross country ski 14. As will be explained more fully hereinafter, the ski binding 10 herein incorporates a tongue-and-slot arrangement in combination with a releasable wire clamp which minimizes lateral, longitudinal and rotational play between the ski boot and binding while allowing free pivotal movement between the boot and skis.

The ski binding 10 comprises a front or base plate 16 and a rear or pivot plate 18 hinged to the base plate for relative pivotal movement about a generally horizontal axis 20 extending transverse or perpendicular to the ski 14. The plates 16 and 18 can be formed of metal or other suitable rigid material. For example, the plates 16 and 18 can be constructed from aluminum plate stamped and bent into the forms shown. The form of plate 16 is apparent from FIGS. 1–3, while the form of plate 18 is apparent from FIGS. 5 and 6. The dashed lines indicate fold lines. The base plate 16 is secured to the ski 14 by screws 22 or other suitable fasteners. As illustrated, three screws 22 are utilized for this purpose. The base plate 16 is therefore anchored to the ski 14 and is stationary relative to the ski, pivot plate 18 and boot 12.

Figure 2:
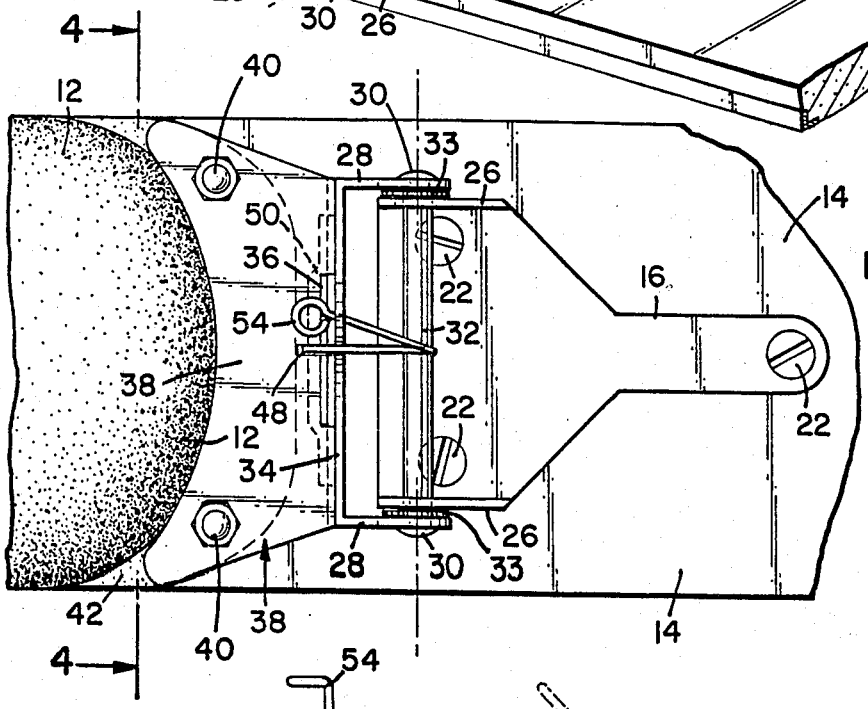
FIG. 2 is a top view of the ski binding.

The pivot plate 18 is connected to the rear of the base plate 16 for pivotal movement. The arrow 24 indicates the forward direction. Plates 16 and 18 can be connected together for relative pivotal movement in any suitable manner. In the preferred embodiment, opposite lateral sides of the base plate 16 are turned upwardly to form a pair of integral upstanding lugs 26, while opposite lateral portions of the pivot plate 18 are turned forwardly to form a corresponding pair of lugs 28 thereon for cooperation with the lugs on the base plate. The lugs 26 and 28 are connected together by means of rivets 30 extending through holes in the lugs, with the inner ends of the rivets being secured by a common cross tube 32. If desired, the heads of rivets 30 and the outer surface of the cross tube 32 can be plated with zinc or chrome for corrosion protection. A washer 33, as is best seen in FIG. 2, of nylon or other suitable material, is preferably provided between each pair of lugs 26 and 28 to avoid binding and facilitate free pivotal motion of the pivot plate 18.

Figure 3:
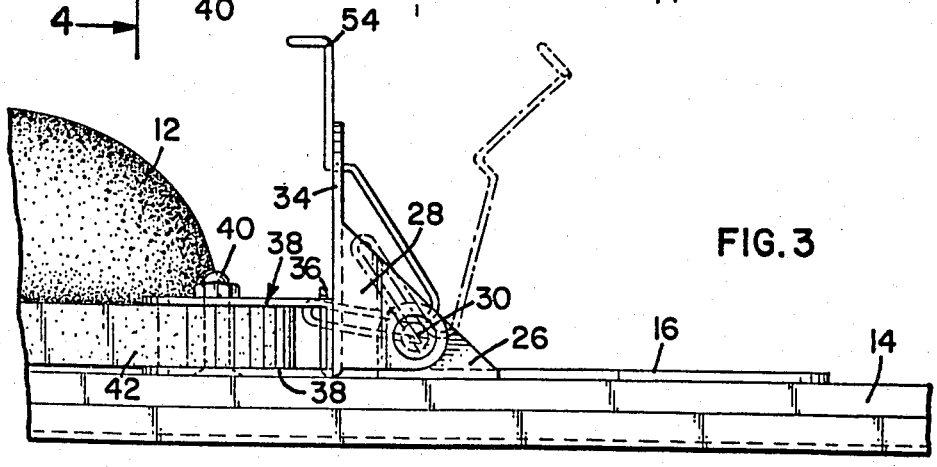
FIG. 3 is a side view of the ski binding.

The pivot plate 18 is adapted for connection to the ski boot 12 by means of a unique tongue-and-slot arrangement. In particular, the plate 18 is formed into generally J-shaped cross section, as is best seen in FIGS. 3 and 6, having a wide transverse front portion 34 extending between lugs 28, and a relatively narrow transverse rear portion 36 extending behind and in closely-spaced relationship with the front portion. The rear portion 36 of pivot plate 18 defines a transverse tongue or flat lug for receiving a slotted toe plate 38 on the ski boot 12.

The toe plate 38 is of generally C-shaped cross section and can be formed of aluminum plate stamped and bent into the form shown, as is best seen in FIGS. 7 and 8. The toe plate 38 is secured by fasteners 40 such as screws and nuts or other suitable fasteners, to the forwardmost or toe portion of the sole 42 of ski boot 12. The toe plate 38 includes an upper portion 43, lower portion 44, and front portion 46, all of which are preferably formed an integral piece of metal plate cut and bent as shown. Slots 48, 50 and 52 are respectively provided in the portions 43, 44 and 46 of the toe plate 38. Lateral slots 48 and 50, which are located adjacent to the front portion 46 of the toe plate 38 so that the front end of the toe plate snugly fits between the front and rear portions 34 and 36 of plate 18 (incomplete). Vertical slot 52 in front portion 46 adjoins slot 48. The dimensions of slots 48 and 50 and the spacing between portions 34 and 36 of plate 18 are of relatively close tolerance to provide a tight fit without play.

It will thus be appreciated that the tongue-and-slot arrangement of binding 10 provides a tight connection which constrains the ski boot against movement away from the ski binding. In addition, abutting engagement between the toe plate 38 and pivot plate 18 over substantially the entire width of the binding 10 provides additional stability against rotation of the ski boot 12 relative to the binding.

The toe plate 38 is releasably secured to the binding 10 by means of a sturdy resilient clamp wire 54. The wire 54 is of generally U-shape and is secured at the lower end to the cross tube 32. The wire 54 can be formed into the shape shown from 14 gauge wire. As is best seen in FIG. 3, the knee of the wire 54 extends through vertical slots 56 and 58 in portions 34 and 36, respectively, of the pivot plate 18 and into slot 52 in the front portion 46 of the toe plate 48. Wire 54 thus serves as a clamp wire to selectively lock the toe plate 38 down on the pivot plate 18. A notch 60 is provided along the slot 56 in pivot plate 18 for securing the wire clamp 54 in locked position.

The ski binding 10 operates as follows. To connect the ski boot 12 to the binding 10, the toe plate 38 is brought down over the upstanding rear portion 36 and secured to the pivot plate 18 by rotating the clamp wire 54 into position within slots 52, 56 and 58. Connection is completed by pressing the clamp wire 54 down and hooking it in locked position within notch 60. This provides a tight, positive connection which prevents rotation and lateral and longitudinal movement between the ski boot 12 and pivot plate 18, while allowing free pivotal motion between the boot and ski 14. To disengage the ski binding 10, the wire clamp 54 is simply unhooked from notch 60 so that the toe plate 38 can be lifted away from the pivot plate 18. A ring is preferably formed on the upper end of wire clamp 54 so that the ski binding 10 can be engaged or disengaged with the tip of a ski pole (not shown).

Referring now to FIGS. 9–11, there is shown a ski binding 70 incorporating a second embodiment of the invention. The ski binding 70 incorporates several components which are substantially identical in construction and function with corresponding components of the ski binding 10. Such corresponding components of the ski binding 70 have been identified with the same reference numerals utilized in conjunction with the ski binding 10, but have been differentiated therefrom by means of prime (') notations.

In contrast to the ski binding 10, which utilizes a generally vertical tongue 36 and slot 50 arrangement together with a pivotal wire clamp 52, the ski binding 70 incorporates a horizontal tongue-and-slot arrangement together with a releasable spring latch for positive connection and stabilization with the ski boot 12. In particular, the toe plate 38' includes a raised portion 72 defining with the upper portion 43', a pair of front and rear transverse horizontal slots 74 and 76. The slots 74 and 76 can be of the same length, but are preferably of different lengths with the rear slot being relatively shorter than the front slot so as to facilitate receipt and centering of the top portion 78 of pivot plate 18'. The top portion 78, which extends rearwardly, defines a horizontal transverse tongue or flat lug for receiving the slotted toe plate 38'. The tongue portion 78 preferably includes portions of different widths corresponding to the sizes of slots 74 and 76. In this manner, the ski boot 12 and toe plate 38' can be positioned on the ski 14 and pushed onto the rearwardly extending portion 78 in the manner of a horizontal tongue-and-slot arrangement, instead of being positioned above and brought down over a vertical tongue-and-slot arrangement as with the ski binding 10.

The ski binding 70 also includes a spring latch which automatically latches upon engagement of the tongue portion 78 with slots 74 and 76 of the toe plate 38'. In particular, the pivot plate 18' includes a raised portion 80 defining a central tab 82 and a latch 84. The tab 82 and latch 84 can be formed by making a channel-shaped cut in the flat raised portion 80 and then bending the latch downward to a transverse, generally horizontal position. The rearward edge of the latch 84 is bent downwardly as shown to form a pawl that snaps into positive engagement with a transverse vertical slot 86 in the top of the raised portion 72 of toe plate 38' when pushed onto the tongue portion 78 of the pivot plate. The raised plate portion 80 is preferably resiliently connected to the pivot plate 18' so that the latch 84 can easily be disengaged with the tip of a ski pole. For example, the latch plate 80 and pivot plate 18' can be interconnected with a plurality of laterally-spaced rivets 88 and compression springs 90 which normally bias the latch 84 downwardly into position for engagement with the slotted toe plate 38'.

FIG. 11 illustrates a modification of the latch plate 80 involving substitution of a latch plate 80*a* of suitable resilient material, such as stainless spring steel, rigidly secured at the lower end by fasteners 92 to the pivot plate 18'. Other than the fact that the ski binding 70 utilizes a horizontal tongue-and-slot arrangement together with a spring latch that automatically snaps into locking position upon proper engagement of the pivot plate 18' and toe plate 38', the ski binding of the second embodiment functions substantially the same as the ski binding 10 of the first embodiment herein.

From the foregoing, it will thus be appreciated that the present invention comprises an improved cross country ski binding having several advantages over the prior art. One significant advantage involves the fact that the binding incorporates a unique tongue-and-slot arrangement in combination with a wire clamp or spring latch to achieve positive connection over a broad contact area extending across the ski binding, thereby eliminating play or relative movement of any type between the ski boot and pivotal portion of the binding. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any equivalents, alternatives, modification, and/or rearrangements within the scope of the following Claims.

What is claimed is:

1. A cross-country ski binding for connecting a ski boot having a slotted toe plate thereon to a ski, which comprises:

a base plate adapted for mounting on a ski;

said slotted toe plate having a raised portion including longitudinally spaced-apart front and rear upright walls and an interconnecting top wall, the front and rear walls having aligned transverse openings therein defining a slot extending longitudinally through the raised portion, and the top wall having a transverse opening therein defining a slot extending vertically into the raised portion;

a pivot plate having a transverse rear portion adapted for snug receipt in the longitudinal slot in the raised portion of said toe plate;

means for hingedly interconnecting said base and pivot plates for relative pivotal movement about a transverse axis; and means including a resilient latch associated with said base and pivot plates and normally urged into position for engagement with the vertical slot in the raised portion of said toe plate for releaseably securing the boot to the binding.

2. The ski binding of claim 1, wherein said means for hingedly-interconnecting said base and pivot plates comprises:

a rivet extending through aligned openings in corresponding longitudinal side portions on either side of said base and pivot plates;

a washer disposed between each pair of corresponding longitudinal side portions of said base and pivot plates; and a transverse member secured between said rivets.

3. The ski binding of claim 1, wherein the slot in the front wall is relatively longer than the slot in the real wall of the raised portion of said toe plate, and wherein the transverse rear portion of said pivot plate is generally tapered in a rearward direction to facilitate centering upon engagement of said toe and pivot plates.

4. The ski binding of claim 1, wherein said latch means comprises:

a generally transverse top plate having front and rear edges, the rear edge defining depending pawl structure adapted for engagement with the slot in the top wall of the raised portion of said toe plate;

means for connecting the front edge of said top plate to said pivot plate for relative movement toward and away from said pivot plate; and means for normally biasing said top plate toward said pivot plate.

5. The ski binding of claim 1, wherein said latch means comprises:

a resilient transverse top plate having front and rear edges, the rear edge defining depending pawl structure adapted for engagement with the slot in the top wall of the raised portion of said toe plate; and means for securing the front edge of said top plate to said pivot plate.

6. The ski binding according to claim 5, further including:

an upstanding tab secured to said top plate and adapted for engagement with the tip of a ski pole to facilitate disengagement of the latch.

7. A cross-country ski binding for connecting a ski boot having a slotted toe plate thereon to a ski, which comprises:

a base plate adapted for mounting on a ski;

said slotted toe plate having a raised portion including longitudinally spaced-apart front and rear upright walls and an interconnecting top wall, the front and rear walls having aligned transverse openings therein defining a slot extending longitudinally through the raised portion, and the top wall having a transverse opening therein defining a slot extending vertically into the raised portion;

a pivot plate having a transverse rear portion adapted for snug receipt in the longitudinal slot in the raised portion of said toe plate;

means for hingedly interconnecting said base and pivot plates for relative pivotal movement about a transverse axis;

a latch mounted on said pivot plate and movable into and out of engagement with the vertical slot in the raised portion of said toe plate when the transverse rear portion of said pivot plate is engaged in the longitudinal slot in the raised portion of said toe plate, for releasably securing the boot to the binding; and means for normally resiliently urging said latch into engagement with the vertical slot in said toe plate.

8. The ski binding of claim 7, wherein said means for hingedly interconnecting said base and pivot plates comprises:

a rivet extending through aligned openings in corresponding longitudinal side portions on either side of said base and pivotal plates;

a washer disposed between each pair of corresponding longituding side portions of said base and pivot plates.

9. The ski binding of claim 7, wherein the slot in the front wall is relatively longer than the slot in the real wall of the raised portion of said toe plate, and wherein the transverse rear portion of said pivot plate is generally tapered in a rearward direction to facilitate centering upon engagement of said toe and pivot plates.

10. The ski binding of claim 7, further including:

an upstanding tab secured to said latch and adapted for engagement with the tip of a ski pole to facilitate disengagement of the latch.

* * * * *